US006408445B1

(12) United States Patent
Matthews

(10) Patent No.: US 6,408,445 B1
(45) Date of Patent: Jun. 25, 2002

(54) PANTY LEG ATTACHMENT DEVICE AND GARMENTS INCORPORATING SAME

(75) Inventor: Diane M. Matthews, East Bend, NC (US)

(73) Assignee: Sara Lee Corporation, NC (US)

( * ) Notice: Subject to any disclaimer, the term of this patent is extended or adjusted under 35 U.S.C. 154(b) by 0 days.

(21) Appl. No.: 08/926,132

(22) Filed: Sep. 9, 1997

Related U.S. Application Data

(63) Continuation-in-part of application No. 08/676,677, filed on Jul. 10, 1996, now abandoned.

(51) Int. Cl.[7] ..... A41B 9/04; A41B 11/04; A41F 19/00; A41C 1/00

(52) U.S. Cl. ..... 2/406; 2/409; 2/240; 2/303; 450/95; 450/111

(58) Field of Search ..... 2/406, 407, 409, 2/239, 240, 303, 311, 312; 450/95, 100, 110, 111

(56) References Cited

U.S. PATENT DOCUMENTS

| | | | | |
|---|---|---|---|---|
| 269,479 | A | * | 12/1882 | Stretch et al. |
| 3,503,405 | A | * | 3/1970 | Porco |
| 3,543,763 | A | * | 12/1970 | Porco |
| 3,566,411 | A | * | 3/1971 | Gordon |
| 3,590,823 | A | * | 7/1971 | Pope |
| 3,638,658 | A | * | 2/1972 | Becker et al. |
| 3,662,760 | A | * | 5/1972 | Erteszek |
| 4,766,613 | A | * | 8/1988 | Wells |
| 5,608,915 | A | * | 3/1997 | Libit |

* cited by examiner

*Primary Examiner*—John J. Calvert
*Assistant Examiner*—Shirra L. Jenkins
(74) *Attorney, Agent, or Firm*—Charles Y. Lackey; Kilpatrick Stockton LLP

(57) ABSTRACT

A panty leg attachment device, a panty garment combined with the device, and a panty/combination leg covering garment utilizing the device enables the securement of the open end of a tubular leg covering garment to a leg opening of a panty garment. The device in one embodiment is formed from a panty inner band with first and second sides, the first inner band side affixed to the panty garment inner side and the second inner band side having securing means in the form of tape segments positioned thereon. A panty outer band having first and second sides has its second side secured to the panty garment outer side and carries a scalloped decorative edge along its perimeter. A tubular leg covering garment elastic band with first and second sides is secured along its first side to the first inner band side at the leg garment open end and the second side has a plush covering releasably securable to the panty garment second inner band tape segments which cooperate to hold the leg covering garment in a substantially fixed relationship with the panty, while the panty and leg covering garment are being worn. Another embodiment includes a foldable elastic segment secured to the leg opening of the panty garment which form inner and outer bands that cooperate to grasp the tubular leg covering garment elastic band which carry tape segments with microfine hook fasteners positioned thereon. The attachment device secures the panty garment leg opening to the open end of the tubular leg covering garment and conceals the secured ends from view to form a fashionable garment.

10 Claims, 4 Drawing Sheets

PANTY LEG ATTACHMENT DEVICE AND GARMENTS INCORPORATING SAME

This is a continuation-in-part application of my application Ser. No. 08/676,677 filed Jul. 10, 1996 for PANTY LEG ATTACHMENT DEVICE AND GARMENT INCORPORATING SAME, now abandoned.

BACKGROUND OF THE INVENTION

1. Field of the Invention

The present invention relates generally to panty and leg covering securing devices and more particularly to a panty leg attachment device for securing a tubular leg covering garment such as a stocking to the leg opening of a panty garment.

2. Description of the Prior Art

There has been a continuing need over the years in developing an acceptable combination garment incorporating the fashion appeal of sheer ladies fashion hosiery and the simplicity of pantyhose that will enable the utilization of a panty and leg covering garment that can continue to be used when a failure occurs in only one of the leg members of the garment. Numerous garments directed to this purpose have been developed in the past. See, for example, U.S. Pat. No. 3,487,662. While these have worked favorably to some degree, they have failed to provide the fit, reliability and appearance desired. In most cases, the structural configuration of such devices has been detrimental to the life of the somewhat fragile garments involved, and damage is early and frequent during use. Moreover, each combination device was restricted to a particular structural use. For example, the device shown in U.S. Pat. No. 3,487,662 could only be used with a panty portion partial leg extended portions. In other cases, only a bikini type garment could be used effectively.

Thus, the industry has failed to develop a combination garment that would enable the attachment of stockings to a panty portion in a similar manner no matter what the configuration of the panty portion might be. Since there is a continuing need and desire for a reliable garment having the versatility noted, it is to that need that the present invention is directed.

BRIEF SUMMARY AND OBJECTIVES OF THE INVENTION

The present invention includes in a first embodiment a leg attachment device and a garment incorporating such a device, the device being used to secure the open end of a tubular leg covering garment, i.e., a stocking, to a leg opening of a panty garment. It includes a panty inner band with first and second sides with a first inner band side affixed to the panty garment inner side and the second inner band sides having securing means positioned thereon. A panty outer band having two sides is secured to the panty garment outer side. A stocking elastic band having a first and second side is secured at its first side to the inner side of the stocking open end. The second side of the stocking elastic band has a plush covering releasably securable to the panty garment second inner band side securing means to hold the stocking in a substantially fixed relationship with the panty when the panty and stocking are being worn.

Another embodiment of the present invention includes the use of a one piece section of elastic fabric which folds along a first fold line to form a panty inner band and a panty outer band secured to the panty garment near the first fold line. The second side of the inner band carries a plurality of tape segments having microfine hook fasteners bonded thereon. The elastic band of the tubular leg covering garment fits between the panty inner band and panty outer band which hold the stocking and panty in position during wear. The panty outer band covers and conceals the joined ends.

Thus, a primary objective of the present invention is to provide a panty leg attachment device incorporating all of the advantages and more of prior art devices and having none of the disadvantages.

Another objective of the present invention is to provide a panty leg attachment of the type described, the components of which can be used with any configured panty portion to uphold various leg covering garments.

Yet another objective of the present invention is to provide an attachment of the type described that is positively securable and attractively worn with reliability and wherein the junction of the panty and leg covering garment ends is securely concealed.

Yet still another further objective of the present invention is to provide an attachment of the type described wherein the panty portion can be worn separately without stockings and the outer band can function to dress and cover the securing means of the inner band.

Thus, there has been outlined, rather broadly, the more important features of the invention in order that the detailed description that follows may be better understood and in order that the present contribution to the art may be better appreciated. There are, obviously, additional features of the invention that will be described hereinafter and which will form the subject matter of the claims appended hereto. In this respect, before explaining several embodiments of the invention in detail, it is to be understood that the invention is not limited in its application to the details and construction and to the arrangement of the components set forth in the additional description or illustrated in the drawings. The invention is capable of other embodiments now being practiced and carried out in various ways.

It is also to be understood that the phraseology and terminology herein are for the purpose of description and should not be regarded as limiting in any respect. Those skilled in the art will appreciate the concepts upon which this disclosure is based and that it may readily be utilized as a basis for designating other structures, methods and systems for carrying out the several purposes of this development. It is important that the claims be regarded as including such equivalent constructions insofar as they do not depart from the spirit and scope of the present invention.

So that the manner in which the above-recited features, advantages and objects of the invention, as well as others, will become more apparent, are obtained and can be understood in detail, a more particular description of the invention briefly summarized above may be had by reference to the embodiment thereof which is illustrated in the appended drawings, which drawings form a part of the specification and wherein like characters of reference designate like parts throughout the several views. It is to be noted, however, that the appended drawings illustrate only preferred and alternative embodiments of the invention and are, therefore, not to be considered limiting of its scope, as the invention may admit to additional equally effective embodiments.

DETAILED DESCRIPTION OF THE PREFERRED EMBODIMENT

Figure 1:
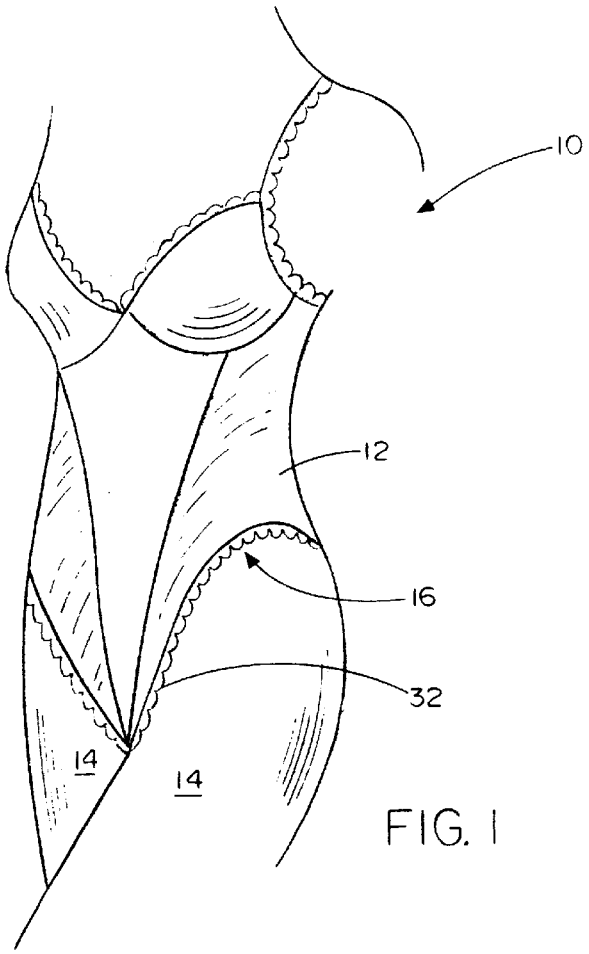
FIG. 1 is a perspective and partial view of a garment including the panty leg attachment device comprising the present invention.
Figure 2:
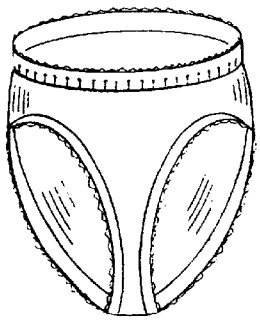
FIG. 2 is a perspective frontal view of another type of panty garment embodying the present inventive concept.
Figure 3:
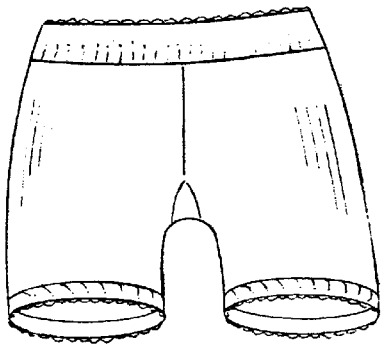
FIG. 3 is a perspective frontal view of yet another type of panty garment embodying the present inventive concept.
Figure 4:
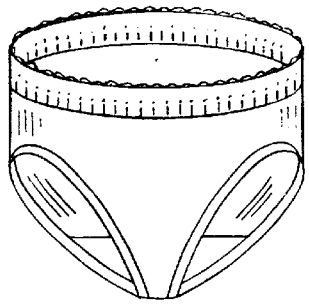
FIG. 4 is yet still another perspective and frontal view of a panty garment embodying the present inventive concept.

Referring now to the drawings and particularly to FIG. 1, a combination garment shown generally as 10 includes a body or panty garment 12 covering the body and pelvic section of the wearer and tubular leg covering garments 14 shown as being ladies fine denier fashion hosiery. Stockings 14 and garment 12 are separate and unconnected except for a panty leg attachment device shown generally as 16 to be more particularly described hereinafter. Device 16 serves to frictionally engage stockings 14 with garment 12 so that they can be interchanged individually if one stocking fails and the other remains intact or totally discarded in the event garment 12 is desired to be worn without stockings.

The device 16 is made up of an inner band shown generally as 18 and an outer band shown generally as 20. Inner band 18 has a first side 22 and a second side 24, first side 22 being affixed to the inner side of garment 12. Second side 24 of inner band 18 carries a plurality of securing devices characterized as tape segments 26, each segment carrying a plurality of microfine hook fasteners for cooperative engagement with a supported stocking to be described more particularly hereinafter. The tape securing segments 26 to inner band 18 by a sonic sealing technique so that it remains substantially flat against the surface of inner band 18.

Outer band 20 has a first side 28 and a second side 30, the second side 30 being secured to the outside surface of garment 12.

Figure 5:
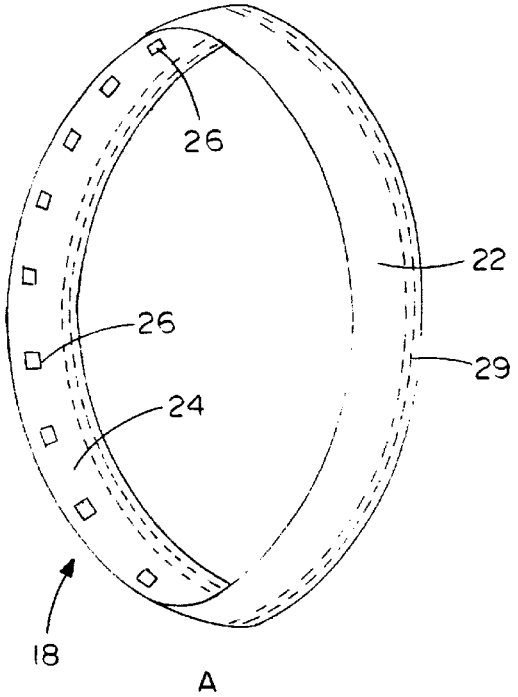
FIG. 5 is a perspective enlarged view of the panty garment inner band showing the first and second sides.
Figure 6:
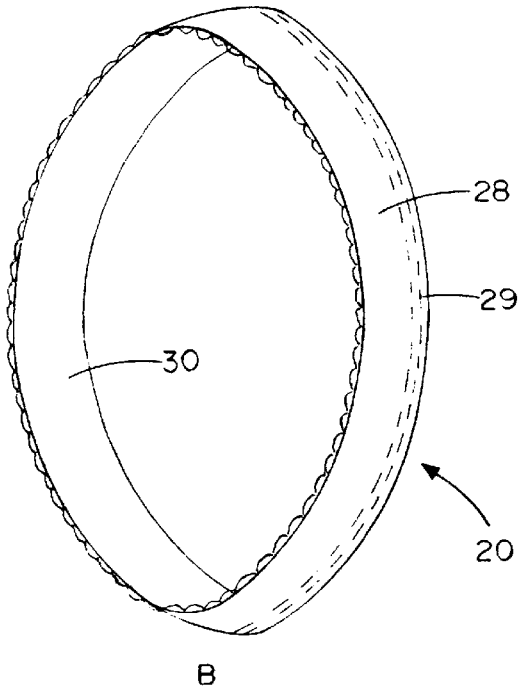
FIG. 6 is a perspective view of the panty garment outer band showing the second side of the band which is subsequently adhered to the outer side of the panty garment.
Figure 7:
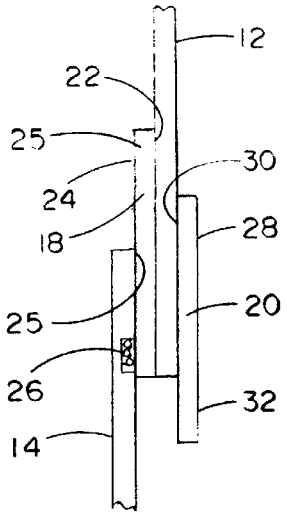
FIG. 7 is an enlarged, cross-sectional view of the panty garment to which is affixed the inner and outer bands with a stocking secured thereby.
Figure 8:
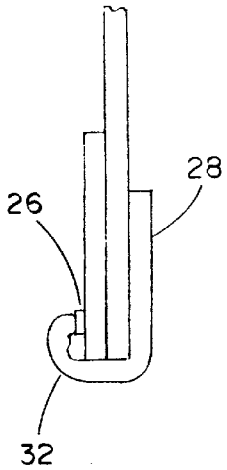
FIG. 8 is an enlarged, cross-sectional view of the panty garment to which is affixed the inner and outer bands with the garment being worn without stockings.
Figure 9:
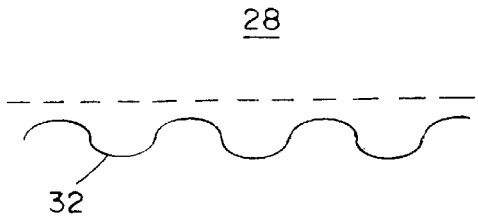
FIG. 9 is an enlarged, side elevational fragmentary view of a scalloped edge of the first side of the outer band affixed to the panty garment.
Figure 10:
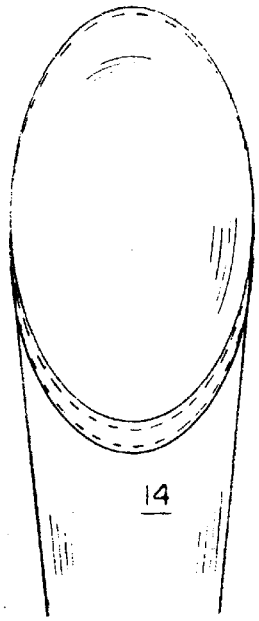
FIG. 10 is a perspective and fragmentary view of a stocking to which is affixed an elastic band having first and second sides, the second side carrying a plush fibrous material.

Inner and outer bands 18, 20 are secured to garment 12 as best shown in FIG. 7, preferably by a double needle cover stitch 29 as shown in FIGS. 5 and 6. Thus, both bands 18, 20 are held against panty garment by the same securing stitches. The lower edge of outside band 20 has a scalloped construction 32 as shown in FIG. 9 and will be described in greater detail subsequently. It is evident that the present invention can be utilized in a combination garment wherein stocking 14 having an elastic band with a plush material side of elastic 25 can be secured to tape segments 26 to hold stocking 14 in a substantially fixed relationship with the panty while the panty and stocking are being worn. In such event, scalloped edge 32 extends below the junction of stocking 14 with inner band 18 to prevent the junction from being seen. Should the wearer desire not to wear stockings 14 with the garment, scalloped edge 32 may be turned under to engage tape segments 26 to provide a neat lower edge to the panty garment as shown in FIG. 8.

Figure 13:
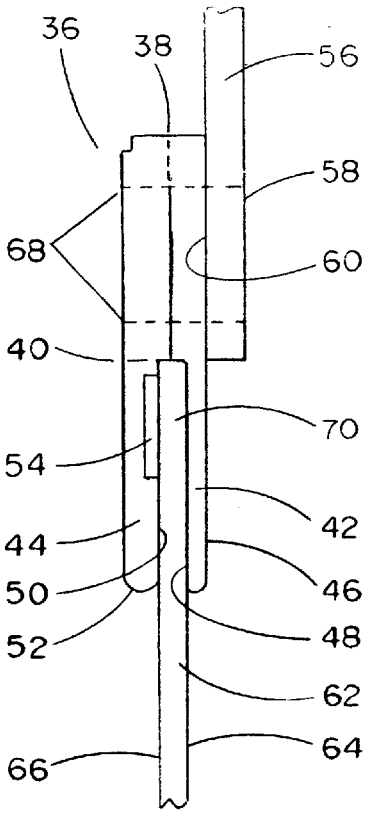
FIG. 13 is an enlarged, cross-sectional and fragmentary view of the panty garment to which is affixed the inner and outer bands of the alternative embodiment of the present invention with a stocking secured thereby.
Figure 14:
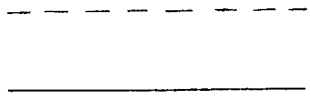
FIG. 14 is an enlarged side elevational fragmentary view of an edge of the first side of the outer band affixed to the panty garment.
Figure 11:
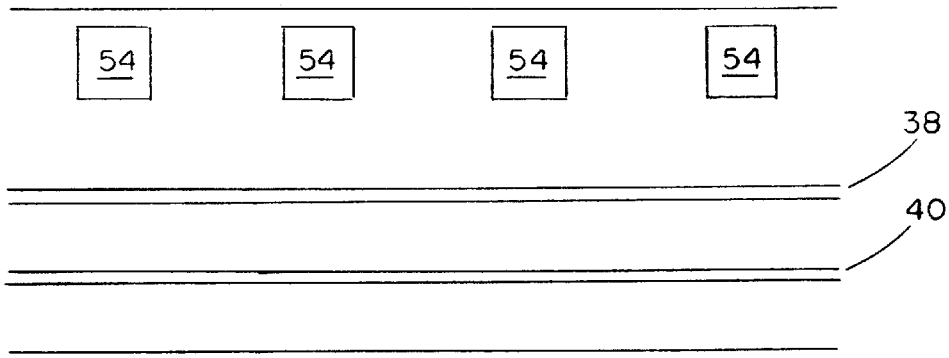
FIG. 11 is a plan, fragmentary and enlarged view of a segment of double foldover elastic material used to produce a second embodiment of the present inventive concept.
Figure 12:
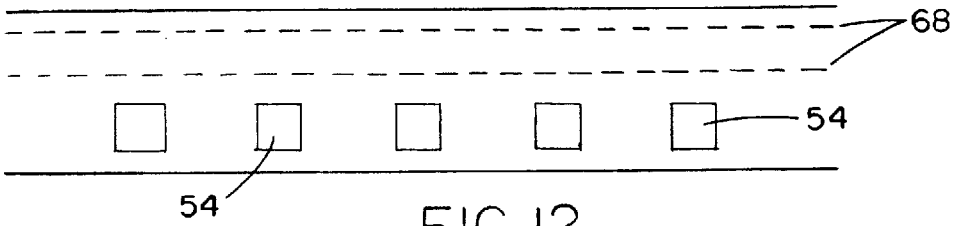
FIG. 12 is a plan, fragmentary and enlarged view of the double foldover elastic material shown in FIG. 11 which has been folded along the first fold line.

Another embodiment of the pantyhose attachment device comprising the present invention is shown in FIGS. 11–13 wherein the attachment device shown generally as 36 is formed from an integral segment of elastic fabric having first and second fold lines 38, 40, fold line 38 functioning to permit the elastic segment to be folded upon itself and form a panty inner band 42 and a panty outer band 44 as shown in FIG. 13. Inner band 42 has first and second sides 46, 48, and outer band 44 has first and second sides 50, 52. Outer band first side 50 carries a plurality of securing segments 54 formed of a plurality of microfine hook fasteners, the segments 54 being sonically bonded to side 50 of band 44.

Panty garment 56 has an inner surface 58 and an outer surface 60, and leg covering or stocking 62 has an inner surface 64 and an outer surface 66. Inner and outer bands 42, 44 are secured to panty leg 56 by a double needle cover stitch 68 as shown in FIG. 13 so that both bands 42, 44 are held against panty garment 56 by the same securing stitches.

Thus, the second embodiment includes the elastic segment folded upon itself to form a panty inner band 42 with first and second sides 46, 48 and a panty outer band 44 having first and second sides 50, 52. Tubular leg covering garment elastic band 70 formed along the top portion of stocking 62 is positioned between bands 42, 44 and against tape segments 54 which grip the fabric of elastic band 70 to hold stocking 62 in position.

The present invention represents a significant breakthrough in the field of ladies fine denier fashion hosiery in that for the first time frictional gripping elements can be used to maintain leg covering garments in position on the legs of a wearer without damaging the fabric of the garment and the use of clips, fasteners and other elements that provide an unsightly appearance or an uncomfortable fit. The small securing segments formed of microfine hook fasteners gently grip the surface of the hosiery fabric without severe penetration to minimize damage to the hosiery fabric. Moreover, softer yarn such as propylene can be used in lieu of nylon in many instances to further reduce the likelihood of damage and increase the comfort of the garment.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the construction may be varied substantially without departing from the spirit of the invention, and the exclusive use of all modifications that come within the scope of the appended claims is reserved.

What is claimed is:

1. A panty leg attachment device for securing an open end of a tubular leg covering garment having an inner and outer side and an elastic top band to a leg opening of a panty garment having an inner side and an outer side, the device comprising: a panty inner band with first and second sides, the first inner band side bonded to the panty garment outer side; a panty outer band having first and second sides, the panty outer band first side having securing segments affixed thereto, the leg covering garment elastic top band having a first and second side, the elastic top band first side engaging the inner band second side and the elastic top second side having a plush covering releasably securable to the outer band side supported securing segments to hold the leg covering garment in a substantially fixed and concealed relationship with the panty garment while the panty and leg covering garments are being worn wherein the securing segments carry microfine hook fasteners that minimize damage to the leg covering garment.

2. A panty leg attachment device for securing an open end of a tubular leg covering garment having an inner and outer side and an elastic top band to a leg opening of a panty garment having an inner side and an outer side, the device comprising: elastic means including a panty inner band with first and second sides, the inner band first side engaging the panty garment outer side and the inner band second side engaging the leg covering garment inner side; a panty outer band having first and second sides, the panty outer band first side engaging the leg covering garment outer side; and a plurality of securing segments fixedly positioned on the outer band first side and in engagement with the leg covering garment outer side to secure the leg covering garment to the panty garment without damage while concealing the secured relationship from view.

3. The device as claimed in claim 2 wherein the securing segments are spaced around the circumference of the outer band first side.

4. The device as claimed in claim 2 wherein the securing segments carry microfine hook fasteners.

5. A panty/leg covering combination garment, the panty portion having leg openings with inner and outer sides, the leg covering portion having inner and outer sides, and the garment including a panty leg attachment device for securing an open end of the leg covering portion to a leg opening of the panty portion and concealing the secured ends from view comprising: elastic means including a panty inner band with first and second sides, the first inner band side engaging the panty portion outer side, and a panty outer band having first and second sides, the outer band first side engaging the leg covering portion outer side; a plurality of securing segments fixedly positioned on the outer band first side; a tubular leg covering portion elastic band forming the top of a leg covering portion and having a first and second side, the band first side engaging the inner band second side and the band second side having a plush covering releasably securable to the securing segments to hold the leg covering portion in a substantially fixed and concealed relationship with the panty portion when the panty and leg covering portions are being worn while minimizing damage to the leg covering portion.

6. The garment as claimed in claim 5 wherein the securing segments carry microfine hook fasteners.

7. The garment as claimed in claim 6 wherein the securing segments are spaced around a circumference of the outer band first side.

8. A panty/leg covering combination garment, the panty portion having leg openings with inner and outer sides, the leg covering portion having inner and outer sides, and the garment including a panty leg attachment device for securing an open end of the leg covering portion to a leg opening of the panty garment portion and concealing the secured ends from view comprising: elastic means including first and second fold lines, a panty inner band with first and second sides, the first inner band side engaging the panty portion outer side, and a panty outer band having first and second sides, the panty outer band first side fixedly supporting a plurality of securing segments and engaging the panty garment outer side proximate the second fold line, the leg covering garment having an elastic band with first and second sides, the elastic band first side engaging the inner band second side and the elastic band second side having a plush covering releasably securable to the securing segments to hold the leg covering portion in a substantially fixed and concealed relationship with the panty portion when the panty and leg covering portions are being worn while minimizing damage to the leg covering portion.

9. The garment as claimed in claim 8 wherein the securing segments carry microfine hook fasteners and the elastic means is integral.

10. The garment as claimed in claim 9 wherein the securing segments are spaced around the circumference of the outer band first side.

* * * * *